US010934077B2

(12) United States Patent
Lee

(10) Patent No.: US 10,934,077 B2
(45) Date of Patent: Mar. 2, 2021

(54) POWDER DISPENSING CONTAINER

(71) Applicant: YONWOO CO., LTD, Incheon (KR)

(72) Inventor: Jae-Ock Lee, Incheon (KR)

(73) Assignee: YONWOO CO., LTD, Incheon (KR)

( * ) Notice: Subject to any disclaimer, the term of this patent is extended or adjusted under 35 U.S.C. 154(b) by 0 days.

(21) Appl. No.: 16/767,265

(22) PCT Filed: Oct. 24, 2018

(86) PCT No.: PCT/KR2018/012622
§ 371 (c)(1),
(2) Date: May 27, 2020

(87) PCT Pub. No.: WO2019/107745
PCT Pub. Date: Jun. 6, 2019

(65) Prior Publication Data

US 2020/0354137 A1 Nov. 12, 2020

(30) Foreign Application Priority Data

Nov. 28, 2017 (KR) ..... 10-2017-0160018

(51) Int. Cl.
*B65D 83/06* (2006.01)
*B05B 11/00* (2006.01)
*A45D 33/02* (2006.01)

(52) U.S. Cl.
CPC ..... *B65D 83/06* (2013.01); *B05B 11/3052* (2013.01); *A45D 33/02* (2013.01); *A45D 2200/055* (2013.01); *B05B 11/305* (2013.01); *B05B 11/3039* (2013.01)

(58) Field of Classification Search
CPC .. A45D 33/02; A45D 33/16; A45D 2200/055; B05B 11/3069; B05B 11/3066; B05B 11/3052–3053; B05B 11/305; B05B 11/3039; B65D 83/06
USPC ..... 222/321.7–321.9, 631, 385, 401
See application file for complete search history.

(56) References Cited

U.S. PATENT DOCUMENTS 4,007,858 A * 2/1977 Shay ..... A45D 33/02 222/633
4,091,966 A * 5/1978 Laauwe ..... B05B 11/0059 222/211
4,770,323 A * 9/1988 Debard ..... B05B 11/0037 222/82
5,082,148 A * 1/1992 Dunning ..... B65D 83/06 128/203.15

(Continued)

FOREIGN PATENT DOCUMENTS

KR 10-0935907 B1 1/2010
KR 10-2012-0059893 A 6/2012

(Continued)

*Primary Examiner* — Paul R Durand
*Assistant Examiner* — Andrew P Bainbridge
(74) *Attorney, Agent, or Firm* — John K. Park; Park Law Firm

(57) ABSTRACT

The present invention relates to a powder dispensing container. When a button is pressed, a piston formed in close contact with the inner wall of an external housing is lowered so that air in the external housing is moved to an inner housing and discharges powder flowing into the internal housing, thus it is possible to always dispense the powder consistently regardless of the amount of the powder stored in a container body.

8 Claims, 10 Drawing Sheets

(56) References Cited

U.S. PATENT DOCUMENTS

| | | | | |
|---|---|---|---|---|
| 6,179,164 | B1 * | 1/2001 | Fuchs | A61M 15/0045 222/321.9 |
| 9,393,583 | B2 * | 7/2016 | Tu | B65D 83/06 |
| 2010/0252656 | A1 * | 10/2010 | Gerbron | B05B 11/062 239/318 |
| 2020/0354137 | A1 * | 11/2020 | Lee | B65D 83/06 |

FOREIGN PATENT DOCUMENTS

| | | | |
|---|---|---|---|
| KR | 10-1378719 | B1 | 3/2014 |
| KR | 10-1590865 | B1 | 2/2016 |
| KR | 10-1717972 | B1 | 3/2017 |

* cited by examiner

POWDER DISPENSING CONTAINER

TECHNICAL FIELD

The present invention relates to a powder dispensing container, and more particularly, a powder dispensing container having a structure wherein when a button is pressurized the air located in an external housing moves to an internal housing as a piston formed close to an inner wall of the external housing descends to discharge powder flowing into the internal housing, thereby always enabling discharging of a constant powder regardless of the amount of powder stored in a container body.

BACKGROUND ART

Generally, powder has its good wearability when applied on skin has its high water-repellency, such that powder is widely being used because a user feels fresh on the skin and gets her makeup to look natural.

This type of powder dispensing container is disclosed in Korean Registered Patent No. 10-1378719 (Hereinafter, referred as 'the Patent Document 1').

The above Patent Document 1 includes: a container body where powder is stored; a button part which is disposed at an upper portion of the container body and ascends/descends according to a user's pressurization, comprising, at one side thereof, a discharging hole such that the powder can be discharged; and a stem which is coupled to a lower portion of the button part and moves along according to the movement of the button part, comprising a powder movement passage where powder moves and an air movement passage where air moves, separately formed at an inner side thereof. It is characterized with a structure wherein an inner pressure of the container body is changed according to pressurization of the button part, and powder and air move into an interior of the stem respectively through a powder movement passage and an air movement passage, such that the powder is sprayed through the discharging hole by the pressure of the air.

In the conventional powder dispensing container having the above-described configuration, as the inner pressure of the container body is changed by the piston coupled to the lower portion of the stem, powder is discharged by moving air and powder through the air movement passage and the powder movement passage, which are separately formed at an inner side of the stem, and as the piston coupled to the lower portion of the stem descends in a state of being tightly contacted with an inner circumferential surface of an extending part, the inner pressure of the container body is changed is changed to discharge powder, such that the amount of powder in the container body decreases, the discharge amount changes, thereby resulting in user inconvenience.

SUMMARY OF THE INVENTION

The present invention is devised to solve such problems described in the above, and the objective thereof is to provide a powder dispensing container having a structure wherein when a button is pressurized the air located in an external housing moves to an internal housing according to the descent of the piston 250 formed in close contact with the inner wall of the external housing 212, thereby always enabling discharging of a constant powder regardless of the amount of powder stored in a container body.

To solve problems above, a powder dispensing container, according to a preferred embodiment of the present invention, is characterized to include: a container body where powder is stored; a stem coupled to a lower portion of an internal button and moving along with ascending/descending movement of the internal button; a piston rod coupled to an inner side of the stem and having a powder movement hole; a seal cap enclosing and coupling to a lower portion of outer circumferential surface of the piston rod to ascend and descend along an inner wall of the internal housing, thereby opening/closing the powder movement hole; a spring which provides an elastic force such that the stem moves upward; a powder pump including a piston which is coupled to a lower portion of the stem, which ascends/descends according to ascending/descending movement of the stem along an inner wall of the external housing, and which changes an inner pressure of the external housing to move the air introduced into the external housing to the internal housing; and an internal button coupled to the upper portion of the powder pump to induce a pumping operation by transferring pressure according to a user's operation to the powder pump, and a discharging hole is formed to discharge powder on one side thereof, wherein the container is characterized to be configured that powder introduced into the internal housing by pressure of air moving from the external housing to the internal housing according to the pressurization of the internal button is sprayed through the discharging hole.

Furthermore, the container is characterized in that at least one air inlet hole is formed in the piston so that external air can move into the external housing.

Furthermore, the container is characterized in that at least one air movement hole is formed on a lower surface of the external housing such that air introduced into the external housing can move to the internal housing through the air inlet hole.

Furthermore, the powder pump is characterized to further includes a piston air valve that opens and closes the air inlet hole so as to control movement of air flowing into the external housing.

Furthermore, the powder pump is characterized to further includes a housing air valve that opens and closes the air movement hole so as to control movement of air flowing into the external housing to the internal housing.

Furthermore, the powder pump is characterized to further includes the valve support body coupled at a lower portion of the housing to support the housing air valve, and the valve support body is formed with an air movement groove that guides movement of air so that air existing in the external housing can move to the internal housing through the air movement hole.

Furthermore, the housing air valve is characterized to includes: a seating protrusion seated on the valve support body; a second opening/closing plate that opens and closes the air movement hole according to a change in pressure inside the external housing; and a sealing tube formed closely contacted at an outer circumferential surface of the internal housing so as to block movement of air to the internal housing, but is separated from the outer circumferential surface of the internal housing by pressure in the process of air movement through the air movement hole and communicate the air movement hole with the air movement groove.

Furthermore, the container is characterized to further includes an external button which is rotatably coupled to encase the internal button and provided with a discharging outlet to communicate with the discharging hole of the internal button, wherein the external button is configured in a way that when the external button rotates to one side direction the discharging outlet communicates with the discharge hole of the internal button, thereby enabling discharge of powder, and when the external button rotates to the other direction the discharging outlet is out of alignment with the discharging hole of the internal button, thereby blocking discharge of powder.

As described above, according to the present invention, when the button is pressurized the air located in the external housing moves to the internal housing according to the descent of the piston formed in close contact with the inner wall of the external housing so as to discharge powder flowing into the internal housing, such that there is an advantage of always enabling discharging the constant powder regardless of the amount of powder stored in the container body.

DETAILED DESCRIPTION OF PREFERRED EMBODIMENTS

Figure 1:
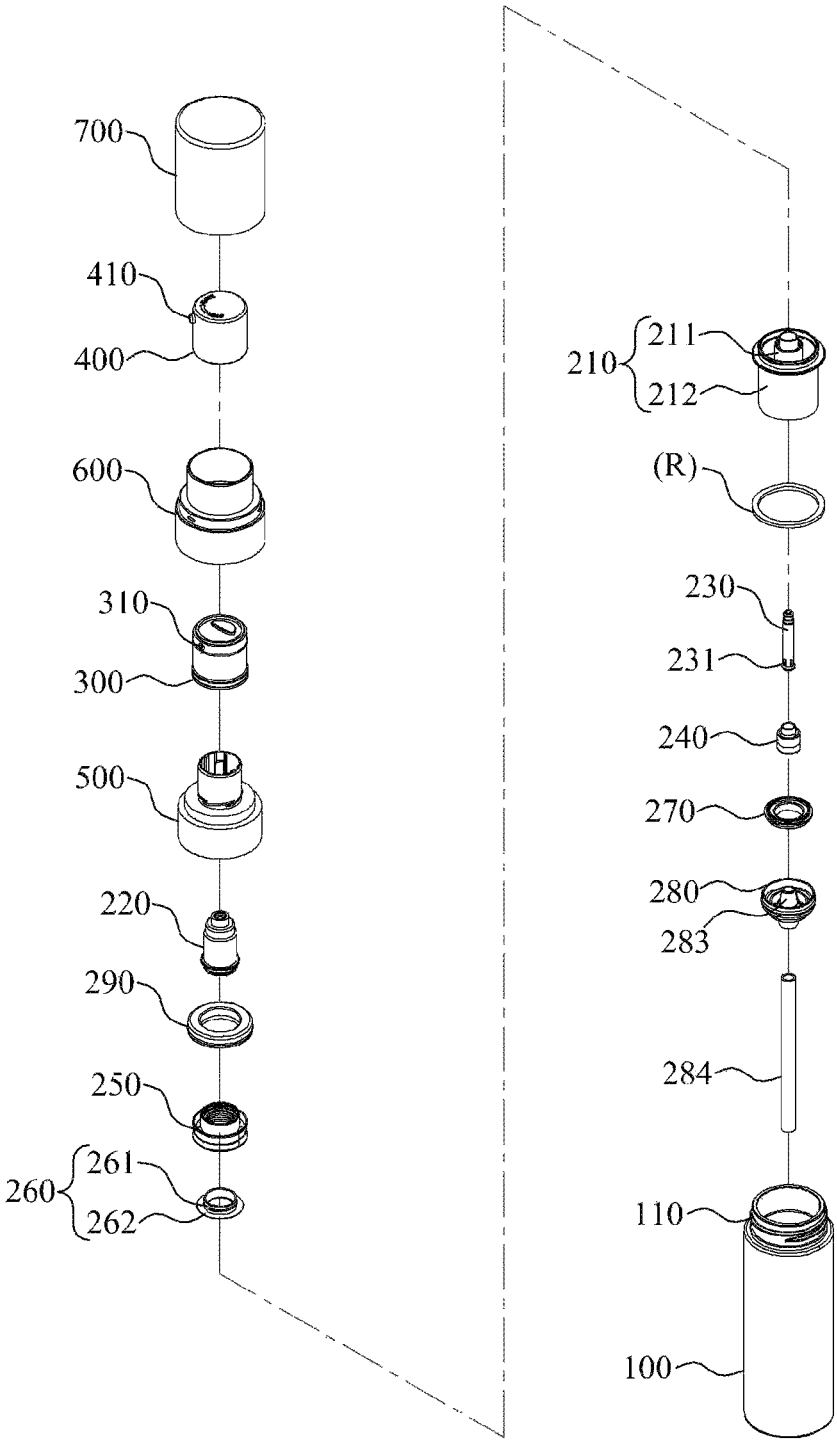
FIG. 1 is an exploded perspective view illustrating a configuration of a powder dispensing container according to an exemplary embodiment of the present disclosure.

Hereinafter, exemplary embodiments will be described in detail with reference to the accompanying drawings. The same reference numerals provided in the drawings indicate the same members.

Figure 2:
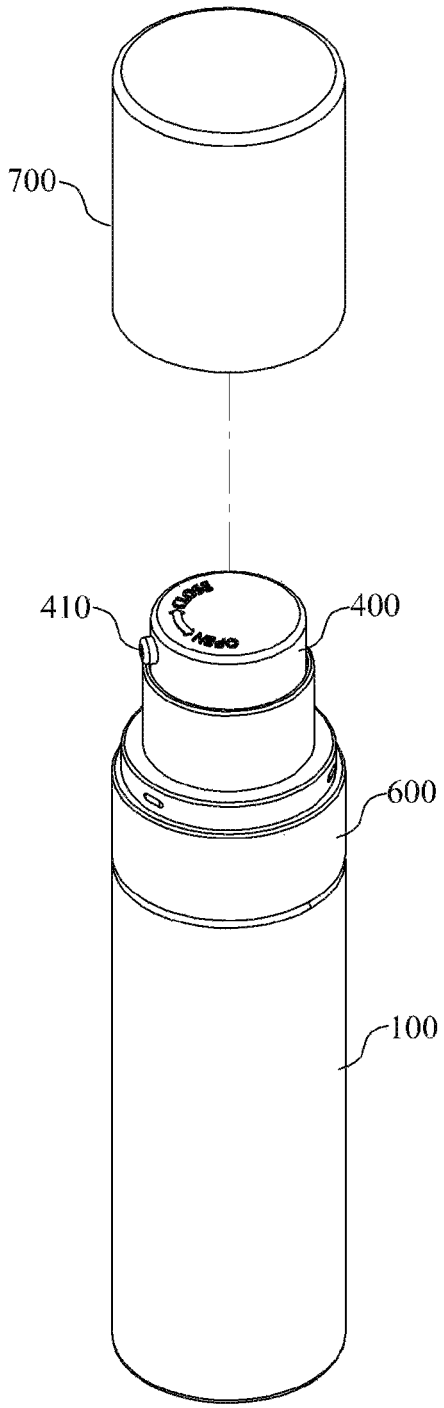
FIG. 2 is an assembled perspective view illustrating a configuration of a powder dispensing container according to an exemplary embodiment of the present disclosure.
Figure 3:
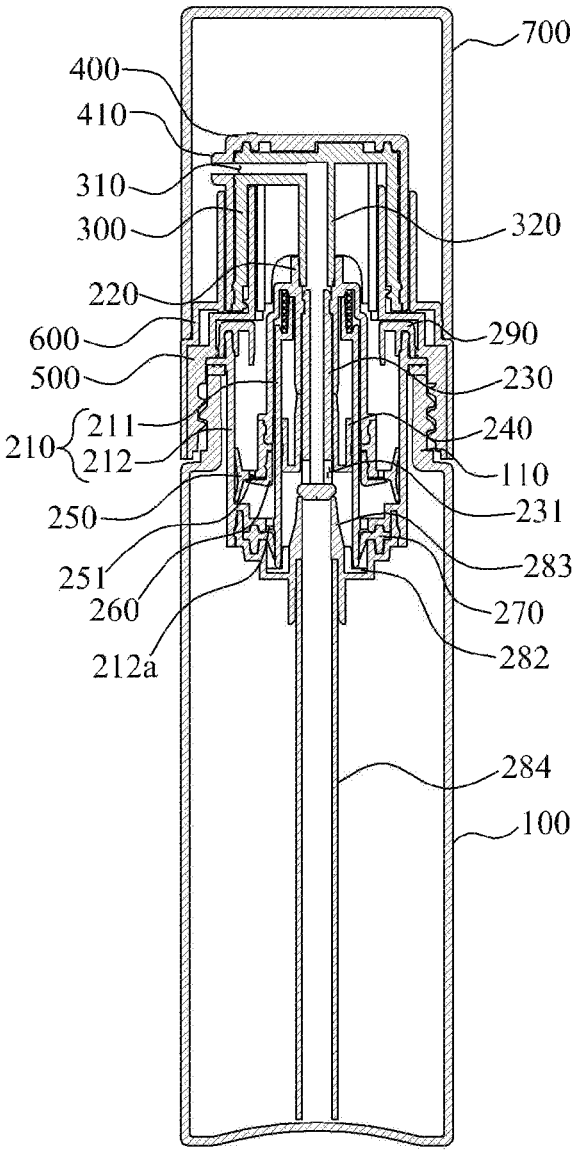
FIG. 3 is an exploded perspective view illustrating a configuration of a powder dispensing container according to an exemplary embodiment of the present disclosure.

FIG. 1 is an exploded perspective view illustrating a configuration of a powder discharging container according to an exemplary embodiment of the present disclosure. FIG. 2 is an assembled perspective view illustrating a configuration of a powder discharging container according to an exemplary embodiment of the present disclosure. FIG. 3 is an assembled cross-sectional view illustrating a configuration of a powder discharge container according to an exemplary embodiment of the present disclosure.

Figure 4:
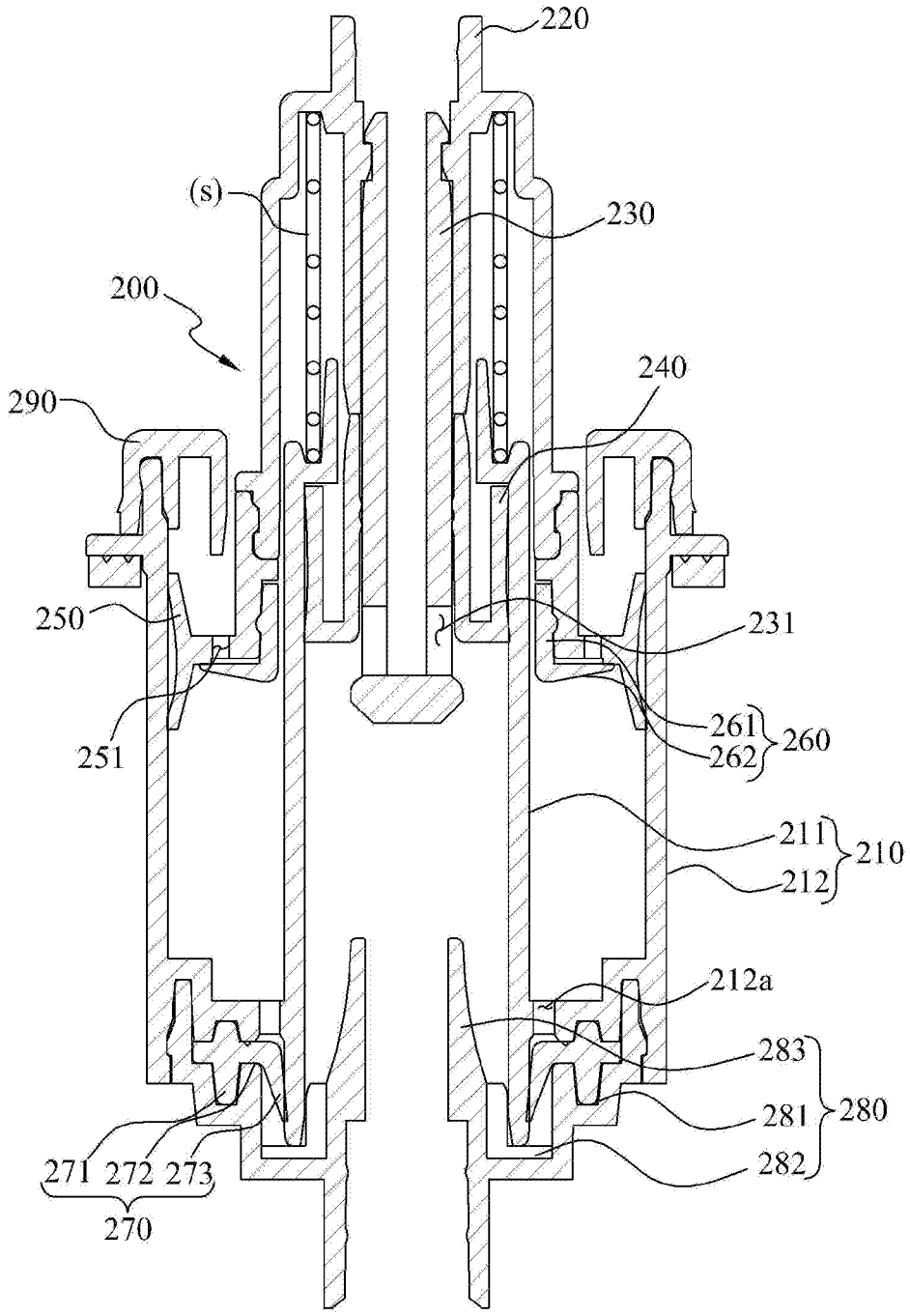
FIG. 4 is an assembled cross-sectional view illustrating a configuration of a powder pump of a powder dispensing container according to an exemplary embodiment of the present disclosure.
Figure 5:
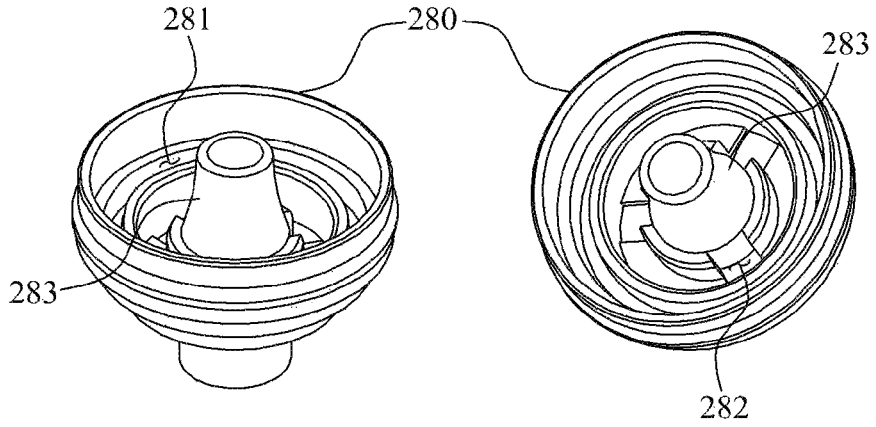
FIG. 5 is an explanatory drawing illustrating a configuration of a valve support body of a powder dispensing container according to an exemplary embodiment of the present disclosure.
Figure 6:
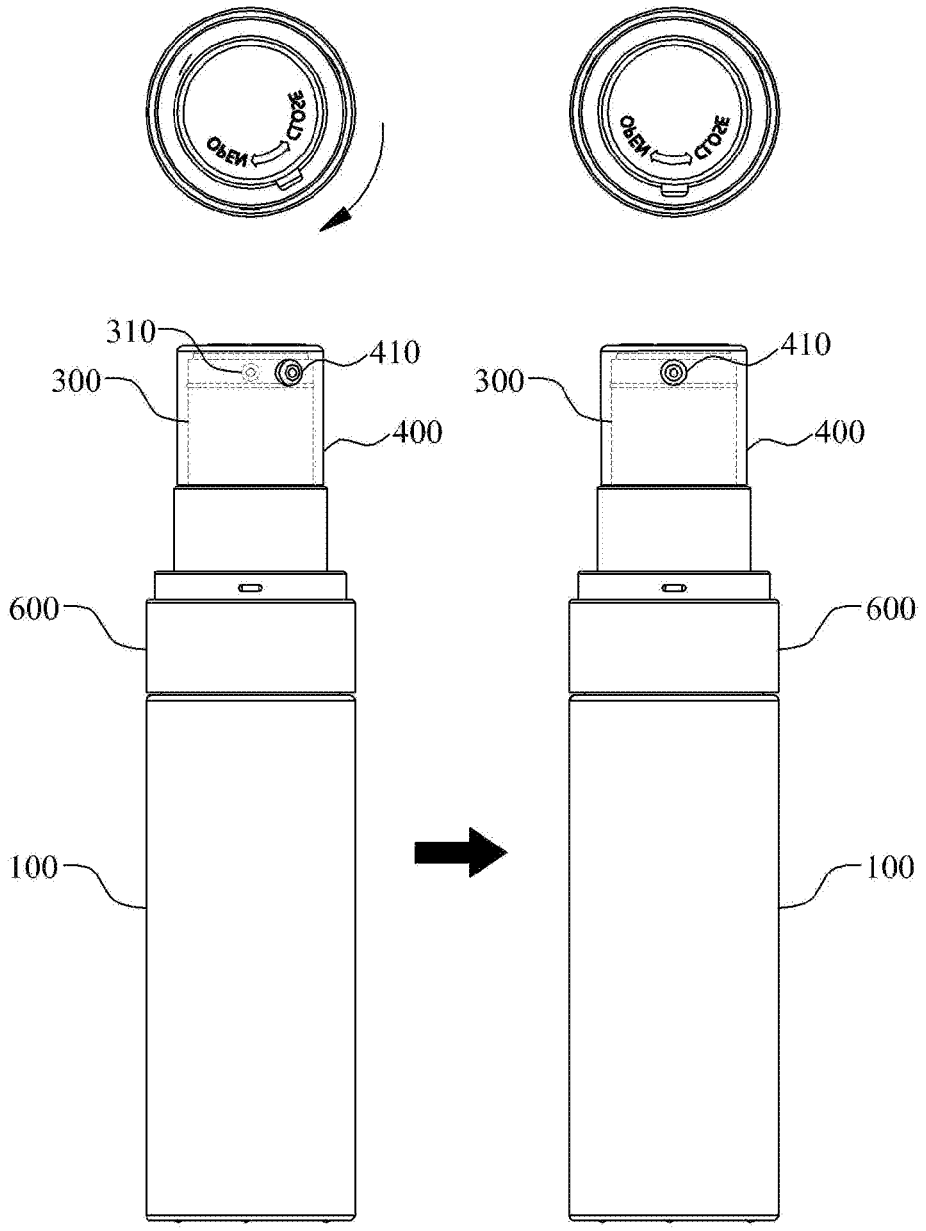
FIG. 6 is an explanatory drawing illustrating a locking structure by rotating an external button of a powder dispensing container according to an exemplary embodiment of the present disclosure.

FIG. 4 is a cross-sectional view illustrating a configuration of a powder pump of a powder discharging container according to an exemplary embodiment of the present disclosure. FIG. 5 is an explanatory drawing illustrating a configuration of a valve support body of a powder dispensing container according to an exemplary embodiment of the present disclosure. FIG. 6 is an explanatory drawing illustrating a locking structure by rotating an external button according to an exemplary embodiment of the present disclosure.

Referring to FIGS. 1 to 6, a powder discharge container according to an exemplary embodiment of the present disclosure includes a container body 100, a powder pump 200, an internal button 300.

The container body 100 containing powder in powder form is provided with a discharge part 110 at an upper portion of thereof such that the stored powder can be discharged, and it is preferable that an O-ring R is installed at an upper end of the discharge part 110 to prevent powder P from flowing out through a space between the powder pump 200 and the discharge part 110.

Meanwhile, at an upper portion of the container body 100 is coupled a fixing body 500 such that the powder pump 200 can be fixedly installed at an upper portion of the container body 100, and at an outer side of the fixing body 500 a decoration part 600 for guiding the vertical movement of an internal button 300 and an external button 400 is coupled.

Furthermore, an overcap 700 encasing the internal button 300 and the external button 400 is coupled detachably at the decoration part 600 so as to prevent malfunction of the internal button 300 and the external button 400, and block foreign substances from entering through a discharging outlet 410.

The powder pump 200 is disposed at an upper portion of the container body 100, performs the pumping operation such that the powder P stored in the container body 100 is discharged to the outside, and includes a housing 210, a stem 220, a piston rod 230, a seal cap 240, a piston 250, a piston air valve 260, a housing air valve 270, a valve support body 280, and a closing cap 290.

The housing 210 is to form a passage through which the powder P and air move, and in the present disclosure, the housing 210 is disposed at a central portion of the container, it is characterized by being configured to be divided into an internal housing 211 forming a passage through which the powder P moves and an external housing 212 formed encasing the internal housing 211 and storing external air.

When the piston 250 descends according to the pressurization of the internal button 300 and the external button 400, the air flowing into the external housing 212 moves to the internal housing 211, to this end, at a lower surface of the external housing 212 at least one air movement hole **212*a* is formed, thereby allowing air to move to the internal housing 211**.

The stem 220 is coupled at a lower portion of the internal button 300 and moves along with the vertical movement of the internal button 300, and induces the pumping operation of the powder pump by moving the piston rod 230 and the piston 250 up and down, thereby making it possible for the powder P moving to an upper portion through the piston rod 230 to move to the discharging hole 310 of the internal button 300.

At an inner side of the stem 220 a spring S is provided to provide an elastic force so that the stem 220 moves upward for a repetitive pumping operation using the internal button 300 and the external button 400.

The piston rod 230 is coupled at an inner side of the stem 220 and moves along with the ascent/descent of the stem 220, at an outer circumferential surface of the lower portion thereof a powder movement hole 231 is formed so that the powder introduced into the internal housing 211 can move to the discharging hole 310 of the internal button 300.

The seal cap 240 is coupled to encase an outer circumferential surface of a lower portion of the piston rod 230, and moves along with the ascent/descent of the piston rod 230 in closely contacted to an inner wall of the internal housing 211, wherein blocking the movement of the powder P along the inner wall of the housing 211 makes it possible to move only through the powder movement hole 231. When the piston rod 230 descends by the pressurization of the internal button 300 and the external button 400, the powder movement hole 231 is opened to allow the powder P introduced into the internal housing 211 to move in the direction of the discharging hole 310, and when the piston rod 230 ascends by the release of the pressurization of the internal button 300 and the external button 400, the powder movement hole 231 is closed to allow the powder stored in the container body 100 to flow into the internal housing 211.

The piston 250 is coupled at an lower portion of the stem 220, and ascends/descends along the inner wall of the external housing 212 according to ascending/descending movement of the stem 220, in the present invention, the piston 250 ascends/descends in a state of being tightly contacted to an inner wall of the external housing 212 and changes the pressure of an inner side of the external housing 212 such that the air introduced into the external housing 212 is moved to the internal housing 211.

At least one air inlet hole 251 is formed in the piston 250 to allow external air to flow into the external housing 212.

The piston air valve 260 opens and closes the air inlet hole 251 to control the movement of air flowing into the external housing 212, and is composed of a coupling tube 261 coupled to the piston 250 and a first opening/closing plate that opens and closes the air inlet hole 251 according to the ascent/descent of the piston 250, wherein the first opening/closing plate 262 closes the air inlet hole 251 when the piston 250 descends, thereby blocking external air from flowing into the external housing 212, and the first opening/closing plate 262 opens the air inlet hole 251 when the piston 250 ascends, thereby allowing external air to flow into the external housing 212.

The housing air valve 270 is to open and close the air movement hole 212*a* so as to control the movement of air introduced into the external housing 212 flowing into the internal housing 211, and is characterized to include: a seating protrusion 271 seated in a valve seating groove 281 of the valve support body 280; a second opening/closing plate 272 which opens and closes the air movement hole 212*a* according to the pressure change inner side of the external housing 212; a sealing tube 273 formed closely contacted at an outer circumferential surface of the internal housing 211 so as to block movement of air to the internal housing 211.

The second opening/closing plate 272 opens the air movement hole 212*a* when the piston 250 descends, thereby allowing air introduced into the external housing 212 to move to the internal housing 211, the second opening/closing plate 262 closes the air movement hole 212*a* when the piston 250 ascends, thereby blocking external air to move to the internal housing 212.

Meanwhile, the sealing tube 273 gets separated from the outer circumferential surface of the internal housing 211 by the pressure in the process of air movement through the air movement hole 212*a*, and is configured to communicate the air movement hole 212*a* with the air movement groove 282, thereby making it possible for the air introduced into the external housing 212 to move to the internal housing 211.

The valve support body 280 is coupled at a lower portion of the housing 210 to support the housing air valve 270, and a valve seating groove 281 in which the seating protrusion 271 of the housing air valve 270 is seated is formed.

The present invention is characterized in that the valve support body 280 is formed with the air movement groove 282 that guides the movement of air so that air existing in the external housing 212 can move to the internal housing 211 through the air movement hole 212*a*, wherein the air movement groove 282, as shown in FIG. 5, is preferably formed in a plurality of air movement grooves 282 in a spaced apart at regular intervals.

Furthermore, at a central portion of the valve support body 280 is provided a powder inlet tube 283 so that powder P stored in the container body 100 can be introduced into the internal housing 211, wherein at a lower portion of the powder inlet tube 283 is coupled a powder suction tube 284 which sucks powder P stored in the container body 100.

The closing cap 290 is coupled to encase an upper portion of the external housing 212, and is configured to limit ascending of the piston 250 in the process of an upward movement of the stem 220 by an elastic force of the spring S.

The internal button 300 is coupled to an upper portion of the powder pump 200 to induce a pumping operation by transmitting pressure according to a user's manipulation to the powder pump 200, wherein at one side thereof a discharging hole 310 is formed to allow powder P to be discharged, and at inner side thereof a communication tube 320 is coupled to an upper portion of the stem 220 to form a passage through which the powder moves is provided.

Meanwhile, it is characterized that at an outer side of the internal button 300 is provided an external button 400 which is rotatably coupled to encase the internal button 300, thereby providing a locking function, and the external button 400 is provided with a discharging outlet 410 to communicate with the discharging hole 310 of the internal button 300, wherein the external button 400 is configured in a way that when the external button rotates to one side direction the discharging outlet 410 communicates with the discharging hole 310 of the internal button 300, thereby enabling discharge of powder, and when the external button 400 rotates to the other direction the discharging outlet 410 is out of alignment with the discharging hole 310 of the internal button 300, thereby blocking discharge of powder P.

Furthermore, it is preferable to display an opening/closing direction with letters or the like at an upper end of the external button 400 such that a user can visually check whether or not the powder P can be discharged.

Hereinafter, an operating state of the powder dispensing container according to an exemplary embodiment of the present invention will be described with reference to FIGS. 7 to 10.

Figure 7:
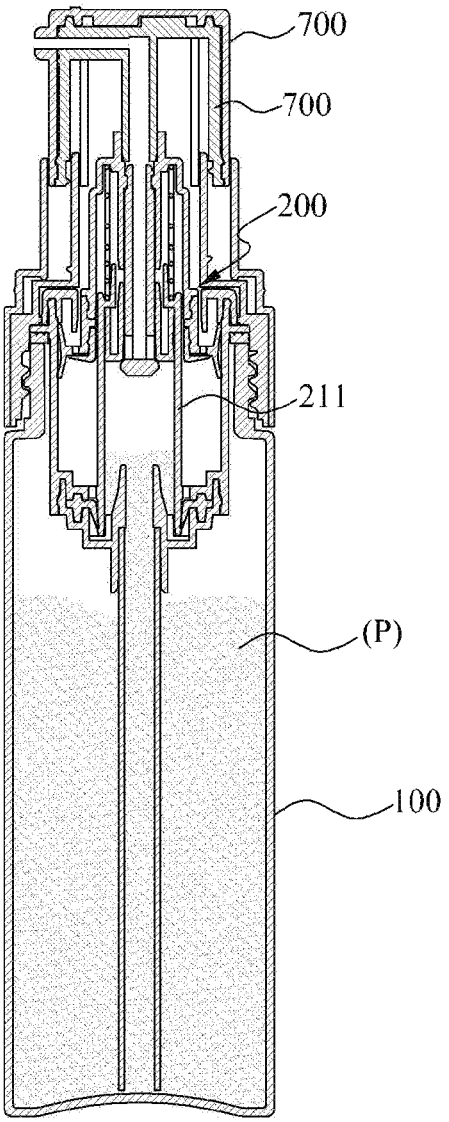
FIGS. 7 to 10 are state diagrams illustrating an operating state of a powder dispensing container according to an exemplary embodiment of the present disclosure.
Figure 8:
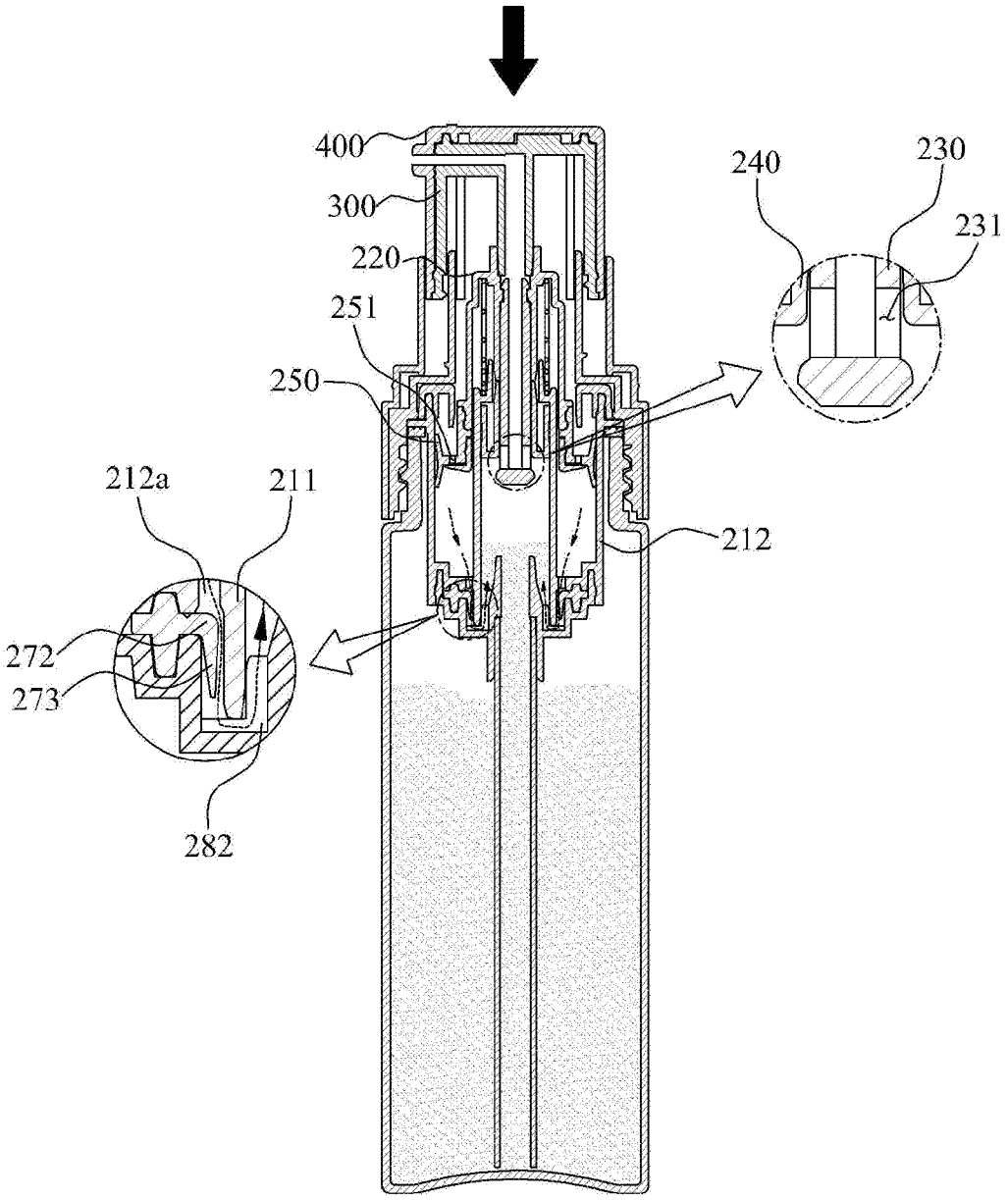

First, referring to FIG. 7 and FIG. 8, when the external button 400 is pressurized in a state that powder P stored in the container body 100 have flowed into the internal housing 211 the internal button 300 coupled at an inner side of the external button 400 moves downward together, wherein the piston 250 coupled to the stem 220 descends according to descent of the stem 220 coupled to the internal button 300, due to this, the air stored in the external housing 212 moves to the internal housing 211 according to a change in pressure inner side of the external housing 212.

As described above, when the piston 250 descends the second opening/closing plate 272 opens the air movement hole 212*a* by the pressure generated inner side of the external housing 212, and the sealing tube 273 gets separated from the outer circumferential surface of the internal housing 211 such that the air movement hole 212*a* communicates with the air movement groove 282, thereby making it possible for the air introduced into the external housing 212 to move to the internal housing 211.

Figure 9:
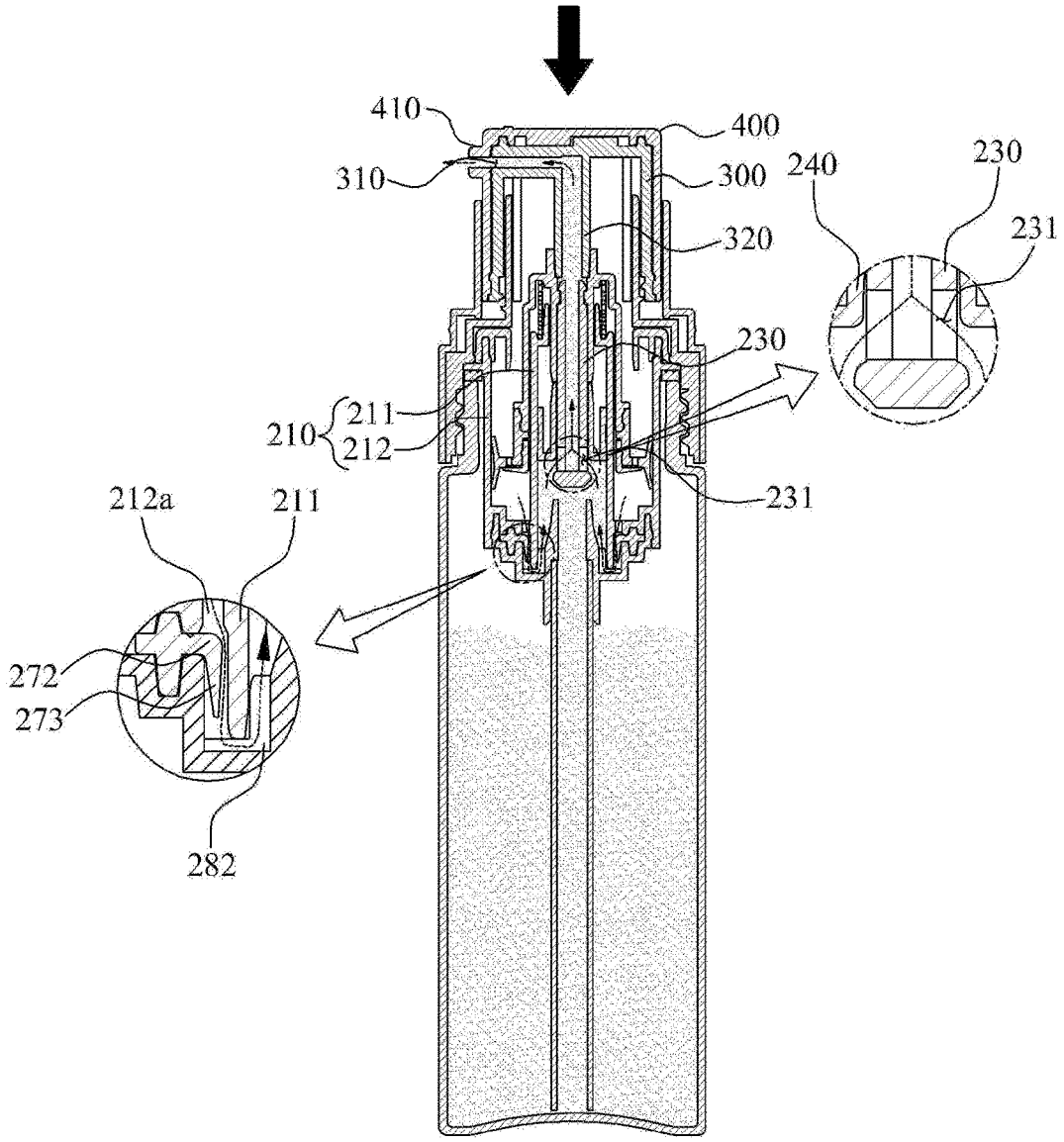

Next, when the air moves to the internal housing 211, as shown in FIG. 9, after the powder P introduced into the internal housing 211 by the air pressure moving to the internal housing 211 moves into the piston rod 230 through the powder movement hole 231 and passes through the communication tube 320, discharge is made to the outside through the discharging hole 310 of the internal button 300 and the discharging outlet 410 of the external button 400.

Figure 10:
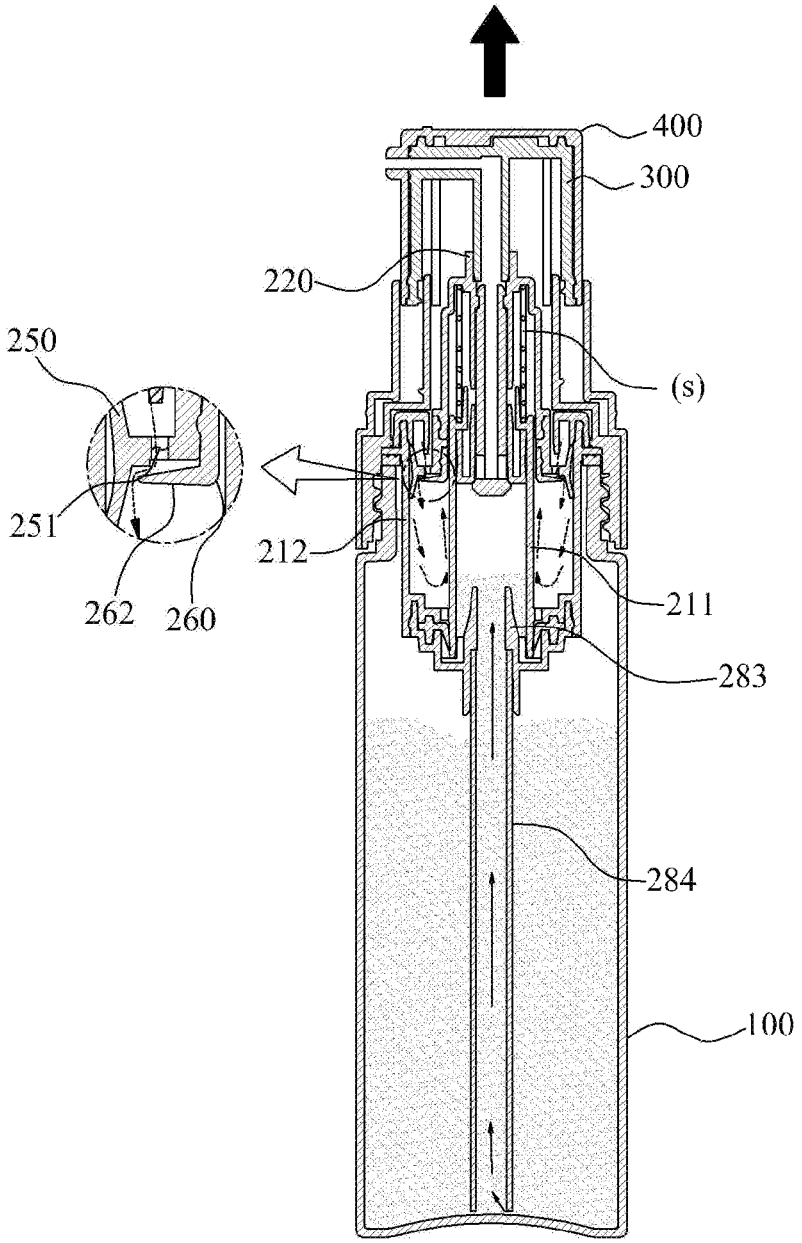

Meanwhile, as shown in FIG. 10, when the pressurization of the external button 400 is released the internal button 300 and the external button 400 coupled at an upper portion of the stem 220 ascend according to the ascent of the stem 200 by the elastic force of the spring S, and at the same time, the piston rod 230 and the piston 250 ascend together, wherein when the piston rod 230 ascends the powder movement hole 231 of the piston rod 230 ascends in a closed state by the seal cap 240, the powder P stored in the container body 100 flows through the powder suction tube 284 and flows into the internal housing 211 through the powder inlet tube 283 by the change in the internal pressure of the internal housing 211, and when the piston 250 ascends the first opening/closing plate 262 of the piston air valve 260 opens the air inlet hole 251 by the change in the internal pressure of the external housing 212 so that the outside air flows into the external housing 212 through the air inlet hole 251.

The present invention, as described above, is characterized in that when the internal button 300 and the external button 400 are pressurized the air located in the external housing 212 moves to the internal housing 211 according to the descent of the piston 250 formed in close contact with the inner wall of the external housing 212 so as to discharge powder P flowing into the internal housing 211, thereby always enabling discharging of a constant powder P regardless of the amount of powder P stored in a container body 100.

Optimal embodiments have been disclosed in the drawings and specification. Although specific terms have been used herein, they are only intended to describe the present disclosure and are not intended to limit the meanings of the terms or to restrict the scope of the present disclosure as disclosed in the accompanying claims. Therefore, those skilled in the art will appreciate that various modifications and other equivalent embodiments are possible from the above embodiments. Accordingly, the true technical protection scope of the present disclosure should be defined by the technical idea of the accompanying claims.

The invention claimed is:

1. A powder dispensing container, comprising:

a container body storing powder;

a housing disposed at an upper portion of the container body and performs pumping operation such that powder stored in the container body is discharged to outside, further comprising an internal housing forming a passage through which powder moves and an external housing formed encasing the internal housing, where external air is stored;

a stem coupled to a lower portion of an internal button and moving along with ascending/descending movement of the internal button;

a piston rod coupled at an inner side of the stem and having a powder movement hole;

a seal cap encasing and coupled to a lower portion of outer circumferential surface of the piston rod to ascend and descend along an inner wall of the internal housing, thereby opening/closing the powder movement hole;

a spring which provides an elastic force such that the stem moves upward;

a powder pump comprising a piston which is coupled to a lower portion of the stem, which ascends/descends according to ascending/descending movement of the stem along an inner wall of the external housing, and which changes an inner pressure of the external housing to move air introduced into the external housing to the internal housing; and an internal button coupled at an upper portion of the powder pump to induce a pumping operation by transferring pressure according to a user's operation to the powder pump, and a discharging hole is formed to discharge powder on one side thereof;

wherein the container is characterized to be configured that powder introduced into the internal housing by pressure of air moving from the external housing to the internal housing according to pressurization of the internal button is sprayed through the discharging hole.

2. The powder dispensing container of claim 1, wherein at least one air inlet hole is formed in the piston such that the external air can flow into the external housing.

3. The powder dispensing container of claim 2, wherein at least one air movement hole is formed on a lower surface of the external housing such that air introduced into the external housing can move to the internal housing through the air inlet hole.

4. The powder dispensing container of claim 2, wherein the powder pump further comprises a piston air valve that opens and closes the air inlet hole so as to control movement of air flowing into the external housing.

5. The powder dispensing container of claim 3, wherein the powder pump further comprises a housing air valve which opens and closes the air movement hole so as to control movement of the air introduced into the external housing to the internal housing.

6. The powder dispensing container of claim 5, wherein the powder pump further comprises a valve support body coupled at a lower portion of the housing to support the housing air valve, and the valve support body is formed with an air movement groove which guides movement of air such that air existing in the external housing can move to the internal housing through the air movement hole.

7. The powder dispensing container of claim 6, wherein the housing air valve comprising:

a seating protrusion seated on the valve support body;

a second opening/closing plate which opens and closes the air movement hole according to a change in pressure inner side of the external housing; and a sealing tube formed closely contacted at an outer circumferential surface of the internal housing so as to block the movement of air to the internal housing, but is separated from the outer circumferential surface of the internal housing by the pressure in the process of air movement through the air movement hole, and communicate the air movement hole with the air movement groove.

8. The powder dispensing container of claim 1, wherein the container further comprises an external button which is rotatably coupled to encase the internal button and provided with a discharging outlet to communicate with the discharging hole of the internal button, wherein the external button is configured in a way that when the external button rotates to one side direction the discharging outlet communicates with the discharge hole of the internal button, thereby enabling discharge of powder, and when the external button rotates to the other direction the discharging outlet is out of alignment with the discharging hole of the internal button, thereby blocking discharge of powder.

* * * * *